US008723616B2

(12) United States Patent
Hirota et al.

(10) Patent No.: US 8,723,616 B2
(45) Date of Patent: May 13, 2014

(54) WAVEGUIDE-MICROSTRIP LINE CONVERTER HAVING CONNECTION CONDUCTORS SPACED APART BY DIFFERENT DISTANCES

(75) Inventors: Akimichi Hirota, Tokyo (JP); Yukihiro Tahara, Tokyo (JP); Naofumi Yoneda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 375 days.

(21) Appl. No.: 13/142,364

(22) PCT Filed: Feb. 5, 2010

(86) PCT No.: PCT/JP2010/051681
§ 371 (c)(1),
(2), (4) Date: Jun. 27, 2011

(87) PCT Pub. No.: WO2010/098191
PCT Pub. Date: Sep. 2, 2010

(65) Prior Publication Data

US 2011/0267153 A1 Nov. 3, 2011

(30) Foreign Application Priority Data

Feb. 27, 2009 (JP) ..... 2009-046365

(51) Int. Cl.
*H01P 5/107* (2006.01)

(52) U.S. Cl.
CPC ..... *H01P 5/107* (2013.01)
USPC ..... 333/26; 333/34; 333/125

(58) Field of Classification Search
CPC ..... H01P 5/107
USPC ..... 333/26, 33, 34, 125
See application file for complete search history.

(56) References Cited

U.S. PATENT DOCUMENTS 6,242,984 B1 6/2001 Stones et al.
6,396,363 B1 * 5/2002 Alexanian et al. ..... 333/26

(Continued)

FOREIGN PATENT DOCUMENTS

EP 1 396 902 A1 3/2004
EP 1 416 577 A1 5/2004

(Continued)

OTHER PUBLICATIONS

International Search Report issued May 11, 2010 in PCT/JP10/51681 filed Feb. 5, 2010.

(Continued)

*Primary Examiner* — Benny Lee
(74) *Attorney, Agent, or Firm* — Oblon, Spivak, McClelland, Maier & Neustadt, L.L.P.

(57) ABSTRACT

Provided is a waveguide-microstrip line converter, including: a waveguide; a dielectric substrate that is connected to cover one end of the waveguide; a strip conductor that is disposed on a front surface of the dielectric substrate; a conductor plate that is disposed the front surface of the dielectric substrate, and connected to the strip conductor; a ground conductor that is disposed on a rear surface of the dielectric substrate; and a plurality of connection conductors that connect a periphery of the conductor plate and the ground conductor, in which: the ground conductor has an opening formed therein in a connection region; the strip conductor and the ground conductor form a microstrip line; and the plurality of connection conductors are arranged so that a distance between two lines of the plurality of connection conductors that are aligned in a longitudinal direction of the microstrip line, and disposed on both opposing sides of the conductor plate in a vicinity of a connection portion is narrower than a distance therebetween in a vicinity of the opening.

8 Claims, 4 Drawing Sheets

(56) References Cited

U.S. PATENT DOCUMENTS

| | | | | |
|---|---|---|---|---|
| 7,148,765 | B2 | 12/2006 | Tahara et al. | |
| 7,205,862 | B2 | 4/2007 | Tahara et al. | |
| 2002/0097108 | A1* | 7/2002 | Jain | 333/26 |
| 2004/0085151 | A1* | 5/2004 | Fukunaga | 333/26 |
| 2004/0119554 | A1 | 6/2004 | Tahara et al. | |
| 2004/0145426 | A1 | 7/2004 | Wu et al. | |
| 2005/0200424 | A1 | 9/2005 | Takeda et al. | |
| 2006/0182386 | A1 | 8/2006 | Stenger | |

FOREIGN PATENT DOCUMENTS

| | | | |
|---|---|---|---|
| EP | 1 592 081 | A1 | 11/2005 |
| JP | 2003 158408 | | 5/2003 |
| JP | 2003-158408 | A | 5/2003 |
| JP | 2003 273612 | | 9/2003 |
| JP | 3 672 241 | | 7/2005 |
| JP | 2005 318360 | | 11/2005 |
| JP | 2005-318360 | A | 11/2005 |
| JP | 2008 271295 | | 11/2008 |
| WO | 2010 026990 | | 3/2010 |

OTHER PUBLICATIONS

Extended Search Report issued May 31, 2013 in European Application No. 10746072.7.

Combined Chinese Office Action and Search Report Issued May 6, 2013 in Patent Application No. 201080007147.3 (with English translation and English translation of Categories of Cited Documents).

* cited by examiner

WAVEGUIDE-MICROSTRIP LINE CONVERTER HAVING CONNECTION CONDUCTORS SPACED APART BY DIFFERENT DISTANCES

TECHNICAL FIELD

The present invention relates to a waveguide-microstrip line converter that can be used for a circuit such a as a microwave circuit or a millimeter wave circuit, and more particularly, to a waveguide-microstrip line converter that mutually converts electric power which propagates in a waveguide and electric power which propagates in a microstrip line.

BACKGROUND ART

A waveguide-microstrip line converter is widely used for connecting a waveguide and a microstrip line. As the waveguide microstrip-line converter, there is proposed a configuration in which a dielectric filled waveguide formed of a dielectric substrate is connected to a waveguide cross section, and slots and conductor patterns are formed in the dielectric filled waveguide (for example, refer to Patent Literature 1).

In the conventional waveguide-microstrip line converter, impedance matching is conducted by adjusting the dimensions of the dielectric filled waveguide formed of the conductor patterns and connection conductors that connect the respective conductor patterns within the dielectric substrate, and the slots and the conductor patterns formed within the dielectric substrate.

CITATION LIST

Patent Literature

[PTL 1] JP 3672241 B2 (FIG. 1 and others)

SUMMARY OF THE INVENTION

Technical Problem

However, the conventional technology suffers from the following problem. In the conventional waveguide-microstrip line converter, because a post wall waveguide is configured by the conductor patterns and the connection conductors, a line of the connection conductors is substantially straight. For that reason, when the post wall waveguide cross section is large, because radiation from a connection portion at which the microstrip line and the waveguide are connected to each other cannot be suppressed, radiation of the waveguide-microstrip line converter becomes large.

The present invention has been made to solve the above-mentioned problem, and has an object to provide a waveguide-microstrip line converter that can suppress radiation from a connection portion at which a microstirp line and a waveguide are connected to each other.

Solution to the Problem

A waveguide-microstrip line converter according to the present invention includes: a waveguide; a dielectric substrate that is connected to cover one end of the waveguide; a strip conductor that is disposed on an end of one surface of the dielectric substrate; a conductor plate that is disposed substantially in a center of the one surface of the dielectric substrate, and connected to the strip conductor; a ground conductor that is disposed on another surface of the dielectric substrate except for a connection region of the waveguide and the dielectric substrate; and a plurality of connection conductors that connect a periphery of the conductor plate and the ground conductor except for a portion that connects the strip conductor and the conductor plate, in which the ground conductor has an opening formed therein in the connection region of the waveguide and the dielectric substrate, in which the conductor plate is disposed to cover the opening through intermediation of the dielectric substrate, in which the strip conductor and the ground conductor form a microstrip line, and in which the plurality of connection conductors are arranged so that a distance between two lines of the plurality of connection conductors that are aligned in a longitudinal direction of the microstrip line, and disposed on both opposing sides of the conductor plate in a vicinity of the connection portion of the strip conductor and the conductor plate is narrower than a distance therebetween in a vicinity of the opening.

Advantageous Effects of the Invention

According to the waveguide-microstrip line converter of the present invention, the connection conductors are arranged so that a distance between the two lines of the connection conductors that are aligned in the longitudinal direction of the microstrip line, and disposed on both of the opposing sides of the conductor plate in the vicinity of the connection portion of the strip conductor and the conductor plate becomes narrower than the distance therebetween in the vicinity of the opening. As a result, because a cross section of the post wall waveguide becomes small at the connection portion, the amount of radiation can be suppressed.

DETAILED DESCRIPTION OF THE EMBODIMENTS

Hereinafter, a waveguide-microstrip line converter according to preferred embodiments of the present invention is described with reference to the drawings.

Embodiment 1

Figure 1:
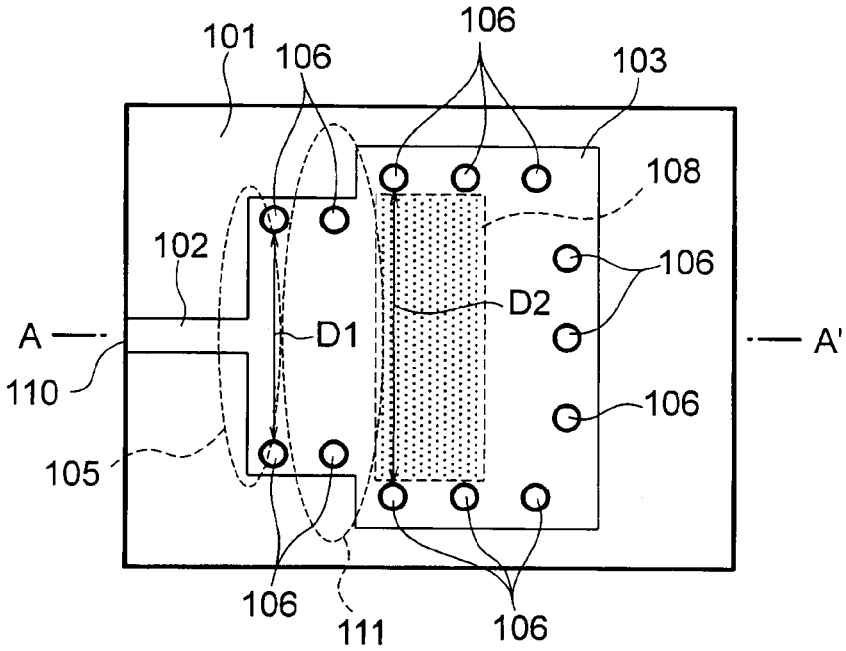
FIG. 1 is a plan view illustrating a configuration of a waveguide-microstrip line converter according to Embodiment 1 of the present invention.
Figure 2:
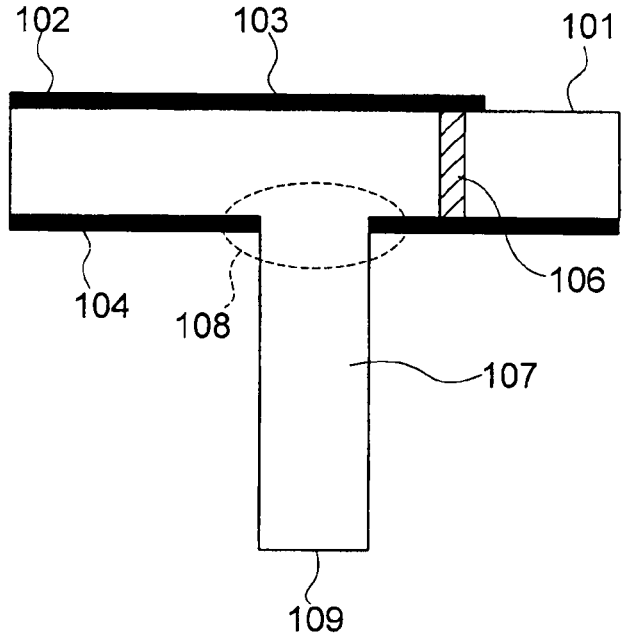
FIG. 2 is a cross-sectional view taken along a line A-A' of FIG. 1.

A waveguide-microstrip line converter according to Embodiment 1 of the present invention is described with reference to FIGS. 1 and 2. FIG. 1 is a plan view illustrating a configuration of the waveguide-microstrip line converter according to Embodiment 1 of the present invention. Further, FIG. 2 is a cross-sectional view taken along a line A-A' of FIG. 1. In the following, in the respective drawings, identical symbols indicate the same or corresponding parts, and which may not be described in detail for all drawing figures in which they appear.

Referring to FIGS. 1 and 2, the waveguide-microstrip line converter according to Embodiment 1 of the present invention includes an oblong (rectangular) dielectric substrate 101, a strip conductor 102 formed on a front surface of the dielectric substrate 101, a conductor plate 103 in the shape of a Kanji character "凸" (convex) which is formed on the front surface of the dielectric substrate 101, a ground conductor 104 (FIG. 2) formed on an overall rear surface of the dielectric substrate 101 (except for an opening 108), 13 pieces of (in multiple) cylindrical connection conductors 106 that connect a periphery of the conductor plate 103 in the vicinity of sides (edges) thereof and the ground conductor 104, except for a side that connects the strip conductor 102 and the conductor plate 103, and a rectangular waveguide 107 (FIG. 2). The waveguide-microstrip line converter mutually converts electric power that propagates in the waveguide 107, and electric power that propagates in a microstrip line formed of the ground conductor 104 disposed on the rear surface of the dielectric substrate 101 and the strip conductor 102 disposed on the front surface thereof.

Further, the strip conductor 102 and the conductor plate 103 are connected by a connection portion 105 (FIG. 1). A rectangular opening 108 is formed in the ground conductor 104 within the waveguide 107. An input/output end 109 of the waveguide 107 is illustrated at a lower side of FIG. 2. An input/output end 110 of the microstrip line formed of the strip conductor 102 and the ground conductor 104 is illustrated at a left side of FIG. 1. A post wall waveguide 111 (FIG. 1) is configured by the conductor plate 103, the ground conductor 104, and the connection conductors 106. As shown in FIG. 1, a distance D1 between lines of the connection conductors 106 in the vicinity of the connection portion 105 is narrower than a distance D2 between lines of the connection conductors 106 in the vicinity of the opening 108 (D1<D2).

Subsequently, an operation of the waveguide-microstrip line converter according to Embodiment 1 is described with reference to the drawings.

A radio frequency signal input from the input/output end 109 of the waveguide 107 is output to the post wall waveguide 111 through the opening 108. The radio frequency signal output to the post wall waveguide 111 is output from the input/output end 110 of the microstrip line through the connection portion 105. An alignment of the connection conductors 106 is so determined as to match impedance. As described above, Embodiment 1 represents an example of functioning as the waveguide-microstrip line converter.

As described above, in Embodiment 1, the distance D1 between two lines of the connection conductors 106 in the longitudinal direction of the microstrip line in the vicinity of the connection portion 105 is narrower than that in the vicinity of the opening 108. Therefore, there is advantageous in that electric power radiated from the vicinity of the connection portion 105 toward the outside of the waveguide-microstrip line converter becomes smaller.

In Embodiment 1, a size (shape) of the opening 108 is identical with a cross section of the waveguide 107, but is not limited to this shape. The opening 108 may be arranged inside the cross section of the waveguide 107, or may be arranged outside so as to cover the cross section of the waveguide 107. That is, the size (shape) of the opening 108 may be smaller or larger than the cross section of the waveguide 107.

Further, in Embodiment 1, a case in which the conductor plate 103 is rectangular is described. However, the conductor plate 103 is not limited to this shape, and may be of other shapes such as circle or polygon.

Further, in Embodiment 1, a case in which the opening 108 is rectangular is described. However, the opening 108 is not limited to this shape, and may be of other shapes such as circle or polygon. A case in which the connection conductors 106 are cylindrical is described. However, the connection conductors 106 are not limited to this shape, and may be of other shapes such as quadrangular prism or polygonal column.

As described above, according to Embodiment 1, the connection conductors 106 are arranged so that the distance D1 between the two lines of the connection conductors 106 in the longitudinal direction of the microstrip line in the vicinity of the connection portion 105 of the microstrip line and the waveguide 107 is narrower than that in the vicinity of the opening 108 of the waveguide 107. As a result, because the cross section of the post wall waveguide 111 in the connection portion 105 becomes small, the amount of radiation can be suppressed.

Embodiment 2

Figure 3:
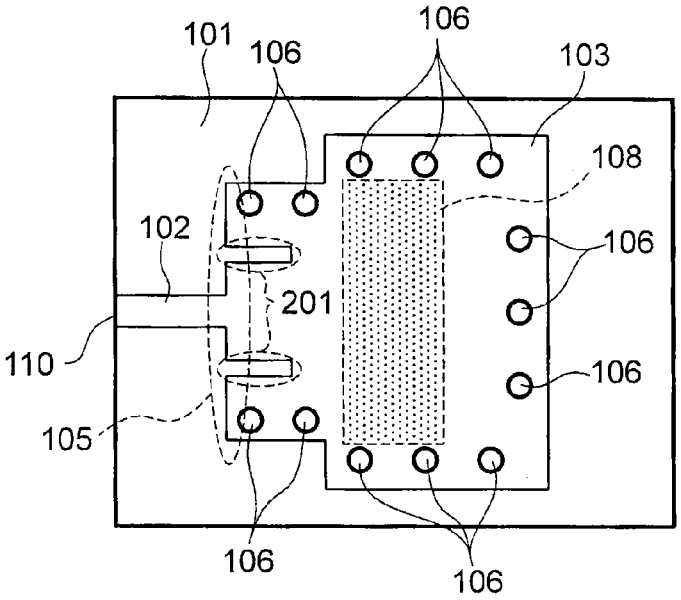
FIG. 3 is a plan view illustrating a configuration of a waveguide-microstrip line converter according to Embodiment 2 of the present invention.

A waveguide-microstrip line converter according to Embodiment 2 of the present invention is described with reference to FIG. 3. FIG. 3 is a plan view illustrating a configuration of the waveguide-microstrip line converter according to Embodiment 2 of the present invention.

In FIG. 3, two notches 201 are formed in the conductor plate 103. The other part of the configuration is the same as that of Embodiment 1, and will not be further described.

Subsequently, an operation of the waveguide-microstrip line converter according to Embodiment 2 is described.

The operation in Embodiment 2 is the same as that in Embodiment 1 described above. However, because a position and a shape of each of the notches 201 may be adjusted to match impedance, there is an effect that the impedance matching is facilitated.

Embodiment 3

Figure 4:
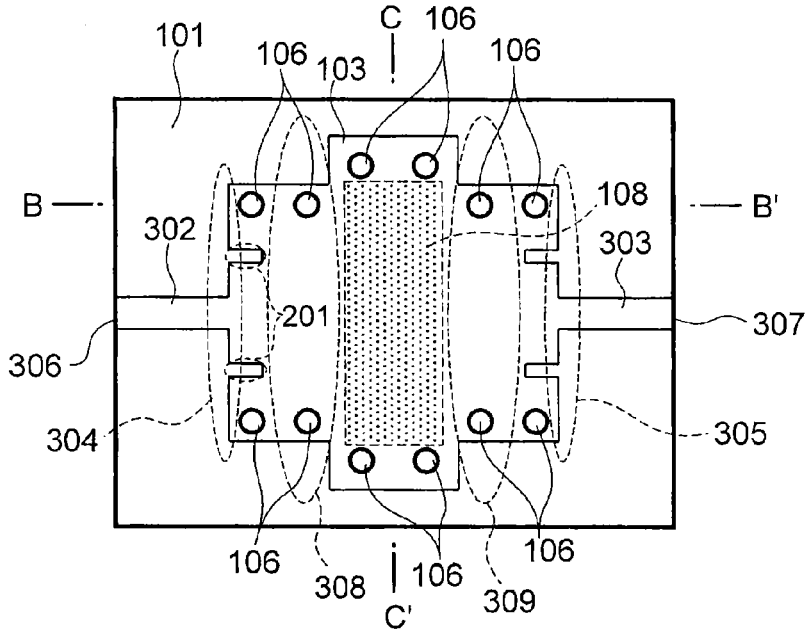
FIG. 4 is a plan view illustrating a configuration of a waveguide-microstrip line converter according to Embodiment 3 of the present invention.

A waveguide-microstrip line converter according to Embodiment 3 of the present invention is described with reference to FIGS. 4 and 5. FIG. 4 is a plan view illustrating a configuration of the waveguide-microstrip line converter according to Embodiment 3 of the present invention. Further, FIG. 5 is a cross-sectional view taken along a line B-B' of FIG. 4.

Figure 5:
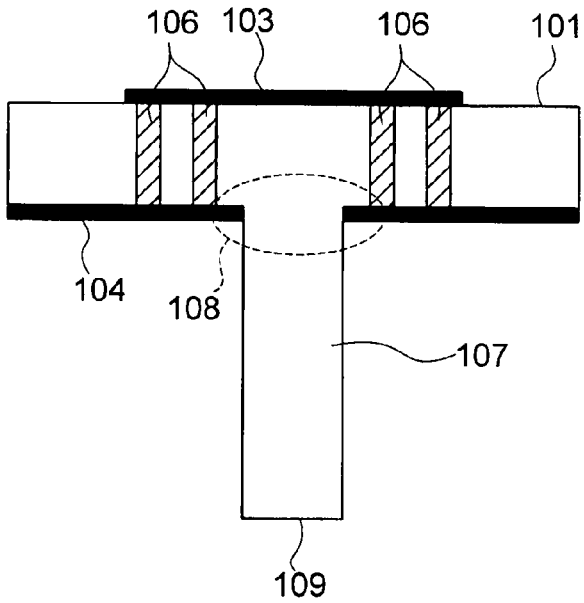
FIG. 5 is a cross-sectional view taken along a line B-B' of FIG. 4.

Referring to FIGS. 4 and 5, two strip conductors 302 and 303 are connected to the conductor plate 103 by connection portions 304 and 305, respectively, as shown in FIG. 4. The waveguide-microstrip line converter has three input/output ends including the input/output end 109 of the waveguide 107, as shown in FIG. 5, and input/output ends 306 and 307 of the microstrip lines, as shown in FIG. 4. Post wall waveguides 308 and 309 are configured by the connection conductors 106, as shown in FIG. 4, the ground conductor 104, as shown in FIG. 5, and the conductor plate 103.

Subsequently, an operation of the waveguide-microstrip line converter according to Embodiment 3 is described.

A radio frequency signal input from the input/output end 109 of the waveguide 107 is output to the post wall waveguides 308 and 309 through the openings 108. However, because the waveguide-microstrip line converter according to Embodiment 3 is symmetric with respect to a cross section taken along a line C-C' of FIG. 4, the cross section taken along the line C-C' can be assumed as an electric wall. Therefore, radio frequency signals are output to the post wall waveguides 308 and 309 in reverse phase to each other. Then, the radio frequency signals output to the post wall waveguides 308 and 309 are output from the input/output ends 306 and 307 of the microstrip lines through the connection portions 304 and 305, respectively. An alignment of the connection conductors 106 and dimensions of the notches 201 are so determined as to match impedance. As described above, Embodiment 3 has an advantage in that such a waveguide-microstrip line converter that outputs the radio frequency signals from the two microstrip lines in reverse phase can be realized.

That is, the waveguide-microstrip line converter according to Embodiment 3 is symmetric with respect to a cross section (a cross section taken along the line C-C') that passes through a center of the inside of the waveguide 107 in the signal propagation direction and a plane parallel to the pipe wall, passes through a plane perpendicular to the dielectric substrate 101, and passes through a plane perpendicular to the longitudinal direction of the microstrip lines.

In the above description, the radio frequency signal is input from the input/output end 109 of the waveguide 107, and output to the input/output ends 306 and 307 of the microstrip lines. However, the same may be applied to a case in which radio frequency signals in reverse phase are input from the input/output ends 306 and 307 of the microstrip lines, and output to the input/output end 109 of the waveguide 107.

Further, in Embodiment 3, a case in which the opening 108 is rectangular is described. However, the opening 108 is not limited to this shape, and may be of other shapes such as circle or polygon.

Embodiment 4

Figure 6:
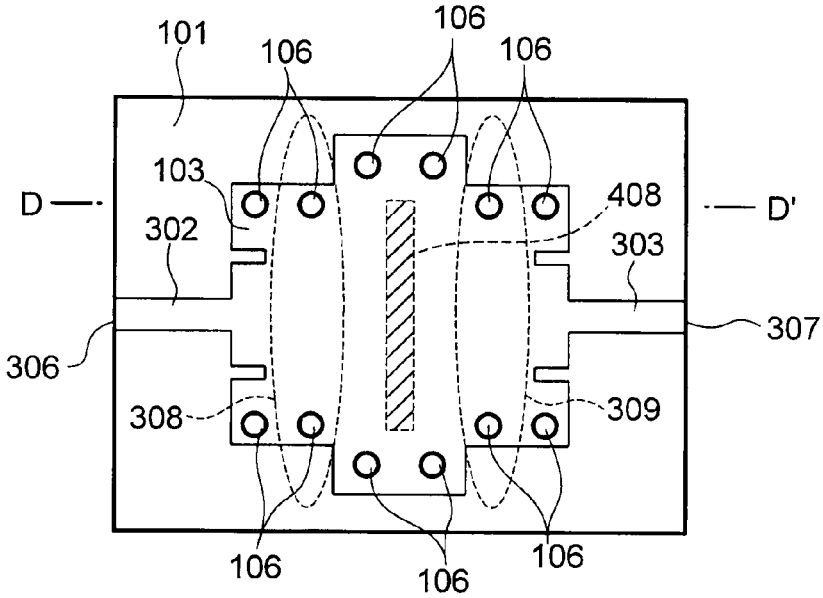
FIG. 6 is a plan view illustrating a configuration of a waveguide-microstrip line converter according to Embodiment 4 of the present invention.

A waveguide-microstrip line converter according to Embodiment 4 of the present invention is described with reference to FIGS. 6 and 7. FIG. 6 is a plan view illustrating a configuration of the waveguide-microstrip line converter according to Embodiment 4 of the present invention. Further, FIG. 7 is a cross-sectional view taken along a line D-D' of FIG. 6.

Figure 7:
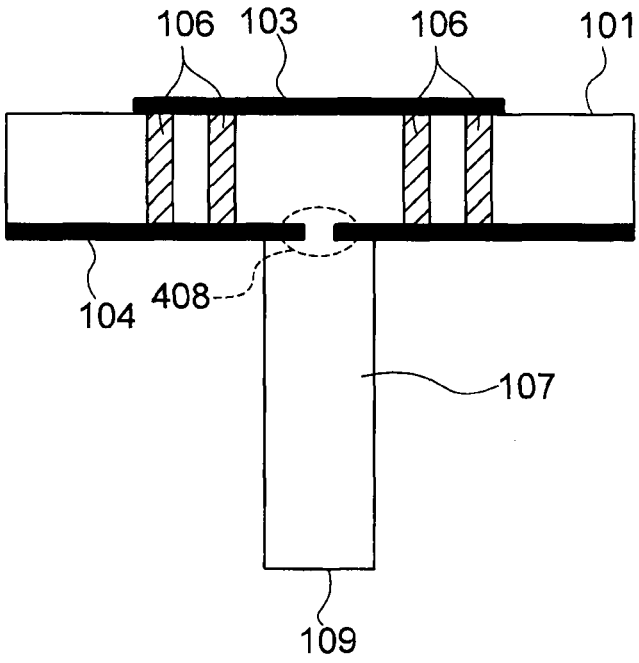
FIG. 7 is a cross-sectional view taken along a line D-D' of FIG. 6.

In FIGS. 6 and 7, an opening 408 is formed in the ground conductor 104 inside a cross section of the waveguide 107, as shown in FIG. 7, which is perpendicular to the propagation direction of the radio frequency signal.

Subsequently, an operation of the waveguide-microstrip line converter according to Embodiment 4 is described.

The operation in Embodiment 4 is the same as that in Embodiment 3 described above. However, the opening 408 is formed inside the cross section of the waveguide 107. Therefore, even if the dielectric substrate 101 and the waveguide 107 are connected so as to be displaced from a design position during the manufacture, there is advantageous in that the characteristic deterioration is low because the opening 408 exists within the cross section of the waveguide 107.

REFERENCE SIGNS LIST

101 dielectric substrate, 102 strip conductor, 103 conductor plate, 104 ground conductor, 105 connection portion, 106 connection conductor, 107 waveguide, 108 opening, 109 input/output end, 110 input/output end, 111 post wall waveguide, 302, 303 strip conductor, 304, 305 connection portion, 306, 307 input/output end, 308, 309 post wall waveguide, 408 opening

The invention claimed is:

1. A waveguide-microstrip line converter, comprising:

a waveguide;

a dielectric substrate that is connected to cover one end of the waveguide;

a strip conductor that is disposed on an end of one surface of the dielectric substrate;

a conductor plate that is disposed substantially in a center of the one surface of the dielectric substrate, and connected to the strip conductor;

a ground conductor that is disposed on another surface of the dielectric substrate except for a connection region of the waveguide and the dielectric substrate; and a plurality of connection conductors that connect a periphery of the conductor plate and the ground conductor except for a portion that connects the strip conductor and the conductor plate, wherein the ground conductor has an opening formed therein in the connection region of the waveguide and the dielectric substrate, wherein the conductor plate is disposed to cover the opening through intermediation of the dielectric substrate, wherein the strip conductor and the ground conductor form a microstrip line, and wherein the plurality of connection conductors are arranged so that a distance between two of the plurality of connection conductors, which are aligned in a longitudinal direction of the microstrip line and are disposed near opposite sides of the conductor plate in the periphery and in a vicinity of the connection portion of the strip conductor and the conductor plate, is less than a distance between another two of the plurality of connection conductors, which are aligned in the longitudinal direction of the microstrip line and are disposed near opposite sides of the conductor plate in the periphery and in a vicinity of the opening.

2. The waveguide-microstrip line converter according to claim 1, wherein the opening is arranged in the longitudinal direction between the another two of the plurality of connection conductors, which is perpendicular to a signal propagation direction.

3. The waveguide-microstrip line converter according to claim 1, wherein the waveguide-microstrip line converter:

is symmetric with respect to a first plane that passes through a center of the waveguide along a central axis of the strip conductor in a signal propagation direction and which is perpendicular to the one surface of the dielectric substrate; and is symmetric with respect to a second plane that passes through the center of the waveguide along a central axis of the opening in the longitudinal direction and which is perpendicular to the one surface of the dielectric substrate.

4. The waveguide-microstrip line converter according to claim 3, wherein the opening is arranged in the longitudinal direction between the another two of the plurality of connection conductors, which is perpendicular to a signal propagation direction.

5. The waveguide-microstrip line converter according to claim 1, wherein the conductor plate has at least one notch formed therein in the vicinity of the connection portion of the strip conductor and the conductor plate.

6. The waveguide-microstrip line converter according to claim 5, wherein the opening is arranged in the longitudinal direction between the another two of the plurality of connection conductors, which is perpendicular to a signal propagation direction.

7. The waveguide-microstrip line converter according to claim 5, wherein the waveguide-microstrip line converter:

is symmetric with respect to a first plane that passes through a center of the waveguide along a central axis of the strip conductor in a signal propagation direction and which is perpendicular to the one surface of the dielectric substrate; and is symmetric with respect to a second plane that passes through the center of the waveguide along a central axis of the opening in the longitudinal direction and which is perpendicular to the one surface of the dielectric substrate.

8. The waveguide-microstrip line converter according to claim 7, wherein the opening is arranged in the longitudinal direction between the another two of the plurality of connection conductors, which is perpendicular to a signal propagation direction.

* * * * *